US005183495A

United States Patent [19]

Ariyama et al.

[11] Patent Number: 5,183,495

[45] Date of Patent: Feb. 2, 1993

[54] METHOD FOR CONTROLLING A FLOW RATE OF GAS FOR PREREDUCING ORE AND APPARATUS THEREFOR

[75] Inventors: Tatsuro Ariyama; Shinichi Isozaki; Kenzo Yamada; Masahiro Matsuo; Genji Kanatani, all of Kawasaki, Japan

[73] Assignee: NKK Corporation, Tokyo, Japan

[21] Appl. No.: 619,759

[22] Filed: Nov. 29, 1990

[30] Foreign Application Priority Data

Dec. 4, 1989 [JP] Japan ..... 1-313259
Feb. 2, 1990 [JP] Japan ..... 2-23749

[51] Int. Cl.[5] ..... C21B 7/24; C21B 13/14

[52] U.S. Cl. ..... 75/379; 75/446; 75/707; 266/80; 266/89; 266/172

[58] Field of Search ..... 75/446, 378, 379, 707; 266/80, 89, 172

[56] References Cited

U.S. PATENT DOCUMENTS 3,033,673 5/1962 Collin et al. .
4,591,381 5/1986 Axelsson et al. ..... 75/444
4,940,488 7/1990 Maeda et al. ..... 75/446

FOREIGN PATENT DOCUMENTS 227009 10/1987 Japan ..... 75/446
63-47307 2/1988 Japan .
63-57709 3/1988 Japan .

*Primary Examiner*—Melvyn J. Andrews
*Attorney, Agent, or Firm*—Frishauf, Holtz, Goodman & Woodward

[57] ABSTRACT

A method for controlling a flow rate of gas for prereducing ore comprises the steps of prereducing ore in a prereduction furnace having a fluidized bed with a gas generated in a smelting reduction furnace and controlling a pressure of gas generated in the smelting reduction furnace and introduced into the prereduction furnace, thereby controlling the actual flow rate of gas introduced into the prereduction furnace. An apparatus for controlling a flow rate of gas for prereducing ore comprises a flow passage for introducing gas generated in a smelting reduction furnace into a prereduction furnace and a gas pressure control valve positioned in the flow passage.

10 Claims, 2 Drawing Sheets

METHOD FOR CONTROLLING A FLOW RATE OF GAS FOR PREREDUCING ORE AND APPARATUS THEREFOR

BACKGROUND OF THE INVENTION

The present invention relates to a method for controlling a flow rate of gas during introduction of process gas generated in a smelting reduction furnace into a prereduction furnace and an apparatus therefor.

DESCRIPTION OF THE RELATED ARTS

A molten iron bath type method for smelting and reducing ore is known as an iron making technology to be used in place of a blast furnace method. In this method for smelting and reducing ore, ore is prereduced by use of reducing gas generated in a smelting reduction furnace to increase the energy efficiency. As the prereduction furnace, a fluidized bed type reduction furnace is often used. In the fluidized bed type smelting reduction furnace, fine material ore can be used as it is, and the fine material ore reacts quickly with the reducing gas.

In the conventional method wherein the fluidized bed type prereduction furnace is used, gas generated in a smelting reduction furnace is introduced as it is into the prereduction furnace. This method is disclosed, for example, in Japanese Patent Publications Laid Open No. 210110/83, No. 23915/87 and No. 60805/87.

The reason why the gas generated in the smelting reduction furnace is introduced as it is into the prereduction furnace is considered as follows:

Firstly, it is advantageous in terms of energy efficiency that the total amount of the gas generated in the smelting reduction furnace is used in the prereduction furnace. Secondly, when a shape and size of the prereduction furnace is predetermined in anticipation of a flow of generated gas, ore can be sufficiently and appropriately prereduced.

In the aforementioned fluidized bed type prereduction furnace, a flow rate of gas introduced into the prereduction furnace should be within an appropriate range, corresponding to a shape and size of the prereduction furnace. When the flow rate of gas is small, ore cannot be fluidized appropriately. When the gas flow rate is excessively large, the amount of ore carried over together with exhaust gas in increased. In any of the cases where the gas flow is excessively small and excessively large, uniform and sufficient prereducing reaction cannot be expected. Particularly, when the gas flow is excessively large, troubles such as blocking in a gas exhaust pipe and the like in apparatuses following the prereduction furnace are liable to be generated.

However, in an operation of the smelting reduction furnace, which, in recent years, has been studied to be put to practical use, a pressure and flow rate of gas generated in the smelting reduction furnace fluctuate greatly. That is, the pressure and flow rate of a reducing gas which is introduced into the prereduction furnace fluctuate greatly. The reason for this fluctuation is as follows:

(a) The method for smelting and reducing ore has a great advantage in that production of iron can be flexibly controlled. Accordingly, operation conditions such as charge of materials, amount of blow-in oxygen, and temperatures inside the smelting reduction furnace change greatly.

(b) A higher pressure of gas inside the smelting reduction furnace can increase the density of gas and can promote the reducing reaction of ore. Moreover, there is an advantage in that the use of the higher pressure of gas enables equipment to be miniaturized. Accordingly, it is advantageous to operate the smelting reduction furnace at a pressure over the atmospheric pressure inside the furnace. The pressure of gas during an operation carried out at a pressure over the atmospheric pressure fluctuates greater than that during an operation carried out at atmospheric pressure.

(c) Various sorts of materials are required to be used to enhance economical efficiency. When coals different in volatile matter from each other are used, for example, an amount of generated gas fluctuates.

In the operation wherein the amount of generated gas fluctuates greatly, ore cannot be appropriately fluidized and cannot be expected to be sufficiently prereduced by means of the conventional method wherein the gas generated in the smelting reduction furnace is introduced as it is into the prereducing furnace.

To solve the above-described problems, an apparatus is designed where a comparatively large amount of gas is generated. When the gas necessary for fluidization of the ore is low during the operation, some of the exhaust gas from the prereduction furnace is recycled, added to gas generated from the smelting reduction furnace and introduced into the prereduction furnace. In this method, however, the pressure of gas is required to be elevated to recycle the gas which is exhausted from the prereduction furnace and whose pressure is a lowered. There is need of a compressor for elevating pressure, an apparatus for cooling the gas and removing dust from the gas on the inlet side of the compressor, and a heating apparatus for elevating the temperature of the gas having passed through those apparatuses. Therefore, it requires a large equipment cost and a large operation cost.

SUMMARY OF THE INVENTION

It is an object of the present invention to provide a method for controlling a flow rate of gas for prereducing ore wherein the ore can be kept in an appropriate fluidized state in a prereduction furnace having a fluidized bed and this state can be realized economically, and an apparatus therefor.

To attain the above-described object, the present invention provides a method for controlling a flow rate of gas for prereducing ore, comprising the steps of:

prereducing ore in a prereduction furnace having a fluidized bed with a gas generated in a smelting reduction furnace; and controlling a pressure of gas generated in the smelting reduction furnace and introduced into the prereduction furnace, and controlling the actual flow rate of the gas introduced into the prereduction furnace being controlled.

Further, the present invention provides a method for controlling a flow rate of gas for prereducing ore, comprising the steps of:

prereducing ore in a prereduction furnace having a fluidized bed with a gas generated in a smelting reduction furnace;

controlling a pressure of gas generated in the prereduction furnace and introduced into the prereduction furnace, the pressure of the gas introduced into the prereduction furnace being controlled by means of a valve positioned in a gas flow passage, through which the gas is introduced from the smelting reduction furnace into the prereduction furnace, on the basis of a value detected by a pressure detector positioned at an inlet port of the prereduction furnace; and controlling a flow rate of gas exhausted from the prereduction furnace, the flow rate of gas exhausted from the prereduction furnace being controlled by a valve positioned in a flow passage of gas exhausted from the prereduction furnace.

The present invention also provides an apparatus for controlling a flow rate of gas for prereducing ore, comprising:

a flow passage for introducing gas generated in a smelting reduction furnace into a prereduction furnace; and a controllable gas pressure control valve positioned in said flow passage.

The above objects and other objects and advantages of the present invention will become apparent from the detailed description which follows, taken in conjunction with the appended drawings.

DESCRIPTION OF THE PREFERRED EMBODIMENTS

The present invention utilizes the principle according to which a volume of compressible fluid is changed by changing a pressure on the fluid. That is, when the pressure of gas generated in the smelting reduction furnace is changed, the volume of the gas is increased or decreased. The actual flow rate of the gas introduced into the prereduction furnace is controlled. The "flow rate" means a flow rate of $Nm^3/hr$ in a standard state of the gas. The term "flow rate" is simply used in this description to designate this "flow rate" of gas. The flow rate of gas at an actual pressure and temperature is referred to as "actual flow rate". The pressure of gas is changed in accord with the amount and pressure of gas generated from the smelting reduction furnace. When the amount of gas generated from the smelting reduction furnace is not large enough to fluidize the ore in the prereduction furnace, the actual flow rate of gas is increased by lowering the pressure of gas flowing into the prereduction furnace. The ore is appropriately fluidized by increasing the actual flow rate of gas. When the amount of gas is excessively large, the actual flow rate of gas is decreased by elevating the pressure of gas flowing into the prereduction furnace. The ore is prevented from carrying over from the prereduction furnace.

According to the apparatus of the present invention, the pressure of gas generated in the smelting reduction furnace can be changed, the actual flow rate of gas can be controlled and the gas can be introduced into the prereduction furnace by regulating the opening of a control valve positioned in the flow passage of gas for introducing the gas generated in the smelting reduction furnace into the prereduction furnace.

Both the control valve for introducing the reducing gas generated in the smelting reduction furnace into the prereduction furnace and the control valve positioned in the flow passage of gas exhausted from the prereduction furnace can be used. When the opening of the control valve positioned in the flow passage of the reducing gas is made smaller and the opening of the control valve positioned in the flow passage of gas exhausted from the prereduction furnace is made larger, the pressure of gas introduced into the prereduction furnace is lowered. When the opening of the control valve positioned in the flow passage of the reducing gas is made larger and the opening of the control valve positioned in the flow passage of gas exhausted from the prereduction furnace is made smaller, the pressure of gas introduced into the prereduction furnace is elevated. According to the apparatus of the present invention, the flow rate of gas can be controlled by only controlling the control valve in such a manner as described above.

Figure 1:
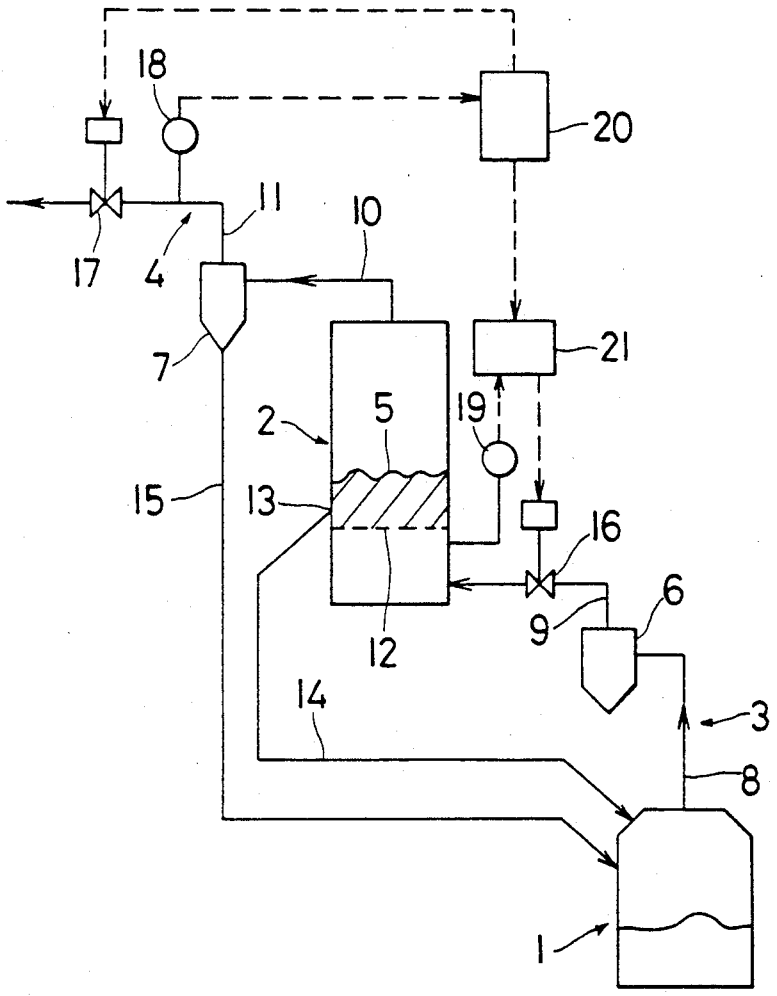
FIG. 1 is a schematic illustration showing apparatus for carrying out the method of the present invention.

FIG. 1 is a schematic illustration showing of an apparatus for carrying out the method of the present invention. In the drawing, reference numeral 1 denotes a smelting reduction furnace, 2 a fluidized bed type prereduction furnace, 3 a flow passage of reducing gas for introducing gas generated in the smelting reduction furnace, 4 a flow passage of gas exhausted from the prereduction furnace, 6 a cyclone positioned in the flow passage of reducing gas, and 7 a cyclone positioned in the flow passage of gas exhausted from the prereduction furnace. The flow passage 3 of reducing gas comprises an upstream duct 8 and a downstream duct 9 of the cyclone 6. The flow passage 4 of reducing gas comprises an upstream duct 10 and a downstream duct 11 of cyclone 7.

Initially, ore is charged into a prereduction furnace 2 and the ore in the solid state is preheated and prereduced therein. The ore preheated and prereduced in the prereduction furnace is charged into a smelting reduction furnace 1 and smelted and reduced. Gas which is generated in the smelting reduction furnace and which contains CO as a main component is introduced into a cyclone through a duct 8 constituting a flow passage of reducing gas 3 and dust in the gas is removed therein. The gas, from which the dust is removed, is introduced into the lower side of the prereduction furnace 2 by means of a duct 9. Powdery and granular ore is put on a distributor 12 having a number of vent holes in the prereduction furnace 2. The ore is fluidized by causing said gas, from which the dust has been removed, to flow from the lower side above the distributor 12, and a fluidized bed 5 is formed. The ore reacts with the reducing gas, is prereduced and preheated, being stirred in the fluidized bed 5. The ore having been preheated and prereduced is discharged from a discharge port 13. Gas discharged from the prereduction furnace 2 is introduced into the cyclone 7 through the duct 10 constituting the flow passage of exhaust gas. After fine ore carried over from the prereduction furnace has been caught by the cyclone 7, the fine ore is sent to a gas processing apparatus through the duct 11.

The prereduced ore discharge from the discharge port 13 is charged into the smelting reduction furnace 1 through a transfer tube 14 by natural drop. The prereduced fine ore caught by the cyclone 7 is transferred to the smelting reduction furnace 1 through the transfer tube 15 and injected into the smelting reduction furnace. The fine ore charged into the furnace through the transfer tube 14 is of medium size and coarse size and the one charged through the transfer tube 15 of small particle size.

In the smelting reduction apparatus as described above, a damper valve 16 which is a valve for controlling the opening of the flow passage 3 of reducing gas is positioned in the middle of the duct 9 constituting the flow passage 3 of reducing gas, and a damper valve 17 which is a valve for controlling the opening of the flow passage 4 of exhaust gas is positioned in the middle of the duct 11 constituting the flow passage 4 of exhaust gas. A detector 18 for detecting a flow rate of gas is arranged at the duct 11 to control the opening of the damper 16. A detector 19 for detecting pressure is arranged in an inlet port of the prereduction furnace 2 to control the opening of the damper 16. An arithmetic and control unit 20 and a comparison controller 21 which control the dampers 16 and 17 on the basis of the values detected by the flow rate detectors 18 and 19 are provided. The flow of introduced gases is controlled by means of the dampers 16 and 17 and the instrumentation means to cause the ore to be appropriately fluidized in the prereduction furnace 2.

Figure 2:
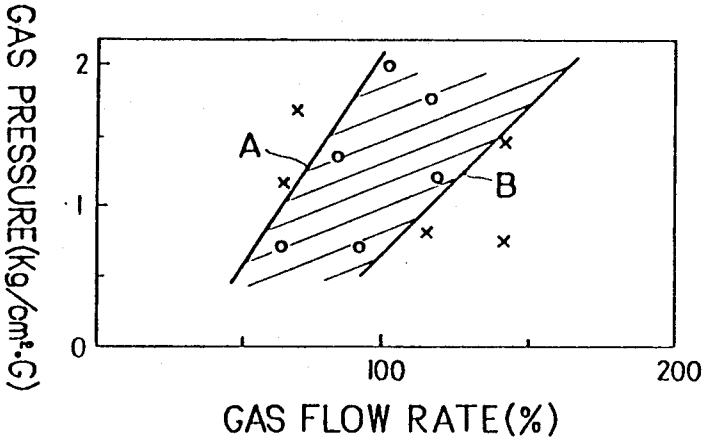
FIG. 2 is a graphical representation showing the relationship between the flow rate of gas and the range of the pressure of gas to fluidize ore appropriately in a fluidized bed type furnace according to the present invention.

To cause the powdery and granular ore to be fluidized in the prereduction furnace 2, it is desired to optimize the actual flow rate of the introduced gases as described above. FIG. 2 is a graphical representation designating the flow rate of gas appropriately fluidizing the ore in the fluidized bed type furnace and the pressure of gas. The abscissa represents the flow rate of gas introduced into the fluidized bed type furnace with the relative value relative to the reference value. The flow rate of gas is the flow rate of gas obtained by converting the volume of gas into a volume of gas in the standard state. The flow rate of gas is represented in $Nm^3/hr$. The ordinate denotes the pressure of gas at the inlet port of the fluidized bed type furnace. The pressure of gas is represented in $kg/cm^2 \cdot G$. The relationship between the minimum flow rate necessary for fluidizing the ore and the pressure of gas at the inlet port of the fluidized bed type furnace is shown with solid line A in FIG. 2. An appropriately fluidized state of the ore cannot be obtained under the conditions in the range to the left of the solid line A. Since the volume of gas is decreased with the elevation of the pressure of gas, the actual flow rate of gas is decreased. Therefore, as clearly seen from FIG. 2, the flow rate of gas necessary for fluidizing the ore is increased with the elevation of the pressure of gas.

Even in the case where the flow rate of gas is decreased and the ore is not appropriately fluidized, when the pressure of gas at the inlet port of the furnace is changed so that the pressure of gas can fulfill the condition in the range to the right of the solid line A, even a small flow rate of gas can be appropriately fluidized again.

Figure 3:
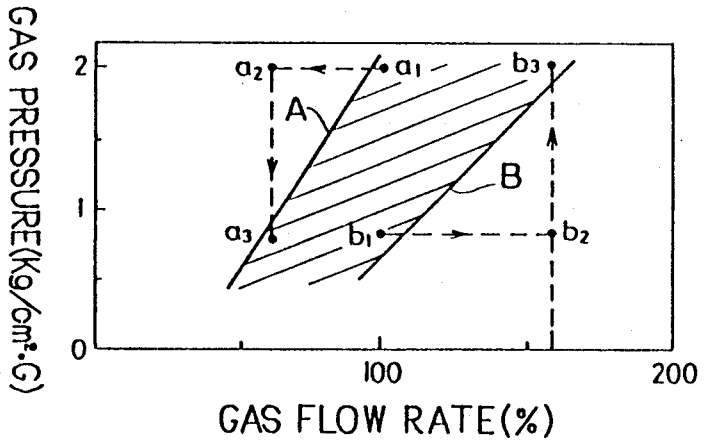
FIG. 3 is a graphical representation showing an example of the case wherein the pressure of gas is controlled in the fluidized bed type furnace according to the present invention.

As shown in FIG. 3, for example, when the flow rate of gas is decreased from point $a_1$ to point $a_2$, the ore is not appropriately fluidized when the pressure of gas at the inlet port of the fluidized bed type furnace remains 2 $kg/cm^2 \cdot G$. The point $a_1$ shows the case where the pressure of gas at the inlet port of the furnace is 2 $kg/cm^2 \cdot G$, and the flow rate is 100%. The point $a_2$ shows the case where the pressure of gas is 2 $kg/cm^2 \cdot G$, and the flow rate is 60%. When the pressure of gas at the inlet port of the furnace is changed from 2 $kg/cm^2 \cdot G$ to 0.8 $kg/cm^2 \cdot G$, the condition enters the range to the right of the solid line A, and the ore is appropriately fluidized again. That is, when the operation is transferred from point $a_2$ to point $a_3$ point, the ore is appropriately fluidized again. The reason why the ore is appropriately fluidized is that even when the flow rate of gas in the standard state is 60%, the actual flow rate of gas is increased by lowering the pressure of gas. When the pressure of gas is changed from 2 $kg/cm^2 \cdot G$ to 0.8 $kg/cm^2 \cdot G$, the actual flow rate of gas becomes about 3.0/1.8 times larger on the basis of the ratio of absolute pressure.

On the other hand, when the flow rate of gas introduced into the fluidized bed type furnace is excessively large, a great amount of the ore together with gas carry over beyond the furnace. The present inventors studied the conditions, under which this problem can be solved.

In the Preferred Embodiment of the present invention, prereduced powdery and granular ore having been carried over from the prereduction furnace 2 is caught by the cyclone 7. The prereduced powdery and granular ore caught by the cyclone 7 is sent to the smelting reduction furnace through the transfer tube 15. The prereduced medium size particle ore and coarse particle ore which are discharged from the discharge port 13 are charged into the smelting reduction furnace 1. The prereduced ore is classified into the powdery-granular ore and the medium size-coarse particle ore. The ore of comparatively coarse particle size out of the powdery and granular ore being carried over beyond the furnace gives rise to blocking and abrasion inside the cyclone 7 and the transfer tube 15. Accordingly, the ore carried over is desired to be of a small particle size. The present inventors studied the relationship between the pressure of gas at the inlet port of the fluidized bed type furnace and the flow rate of gas introduced into the fluidized bed type furnace, taking into account the particle size of the ore carried over. For example, in order that the particle size of the ore carried over can be determined to be 0.5 mm or less, the solid line B in FIG. 2 is determined. The particle size of the ore carried over is 0.5 mm or less in the range to the left of the solid line B. The ore of particle size of 0.5 mm is carried over in the range to the right of the solid line B. The border line (not shown), within which the particle size of the ore carried over is limited to 1.0 mm of less, is set in the range slightly to the right of the solid line B. Substantially all the ore of all the particle sizes is carried over out of the fluidized bed type furnace in the range to the right far away from the solid line B.

Accordingly, to appropriately fluidize the ore of over 0.5 mm in particle size and the classify the ore by carrying over the ore of 0.5 mm or less in particle size, the state of gas at the inlet port of the fluidized bed type furnace is desired to be kept in the range between the solid lines A and B. The range desired is the range represented with oblique lines. The ore is appropriately fluidized and classified in the prereduction furnace by keeping the state of gas at the inlet port of the furnace in the above-mentioned range. It is possible to take counter measures against the fluctuation of the pressure and flow rate of gas generated in the smelting reduction furnace. Since there is a definite relationship between the pressure of gas at the inlet port of the prereduction furnace and the pressure of gas inside the prereduction furnace, the pressure of gas inside the prereduction furnace can be changed or regulated by measuring the pressure of gas inside the prereduction furnace. In the case of changing or regulating the pressure of gas inside the prereduction furnace, the same effect with that of the case of changing or regulating the pressure of gas at the inlet port of the prereduction furnace can be obtained.

A method for changing or regulating the pressure of gas at the inlet port of the prereduction furnace will now be described with specific reference to FIG. 1.

A flow of prereducing gas is controlled by controlling the openings of the damper 16 positioned in the middle of the duct 9 constituting the flow passage 3 of the prereducing gas and the damper 17 positioned in the middle of the duct 11 constituting the flow passage 4 of exhaust gas. A flow rate detector 18 possesses a corrective function by means of the temperature and pressure of gas and outputs the flow rate of gas passing through the duct 11 in terms of the flow rate in the standard state to the arithmetic and control unit 20. The relationship between the pressure of gas and the flow rate of gas at the inlet port of the furnace is preset in the arithmetic and control unit 20. An appropriate relationship between the pressure of gas and the flow rate of gas is represented, for example, with the range shown with oblique lines in FIG. 2. An appropriate pressure of gas at a flow rate input from the flow rate dectector 18 is computed on the basis of the relationship between the pressure of gas and the flow rate of gas at the inlet port of the furnace. A computed appropriate pressure of gas is output to the comparison controller 21, and a control signal of an opening of damper 17 is calculated on the basis of a comparison signal comparing the appropriate or desired pressure with the actual pressure, and the control signal is sent to the damper 17. The opening of the damper 17 is controlled by means of a driving means (not shown) on the basis of the control signal. On the other hand, the pressure of gas at the inlet port of the prereduction furnace 2 is detected by the pressure detector 19 and is outputted to the comparison controller 21. A signal of the actual pressure output and a signal of the appropriate pressure input from the arithmetic and control unit 20 are compared by the comparison controller 21. A control signal is output to the damper 16 to control the opening of damper 16 so that the actual pressure can be controlled to approximate the appropriate or desired pressure. The opening of the damper 16 is controlled by a driving means (not shown) on the basis of the opening control signal. A cascade control determining the pressure of gas at the inlet port of the prereduction furnace 2 in accordance with the flow rate of gas is carried out by means of the control of the openings of the dampers 16 and 17.

An example wherein an operation was carried out under the condition of the pressure of gas of 2 kg/cm$^2$·G generated in the smelting reduction furnace 1 and the pressure of gas of 2 kg/cm$^2$·G at the inlet port of the prereduction furnace and the flow rate of generated gas was decrease from 100% to 60% will now be described with specific reference to FIG. 3. When it is detected by the flow rate detector 18 that the flow rate of gas is 60% relative to the reference value, the appropriate pressure of gas is computed by the arithmetic and control unit 20 on the basis of the detected value of the flow rate. For example, an appropriate pressure of 0.8 kg/cm$^2$·G is computed. In FIG. 3, the case where the pressure of gas at the inlet port is 2 kg/cm$^2$·G and the flow rate of gas is 100% is represented by point a, the case where the pressure of gas at the inlet port is 2 kg/cm$^2$19 G and the flow rate of gas is 60% is represented by point $a_2$, and the case where the pressure of gas at the inlet port is 0.8 kg/cm$^2$·G and the flow rate of gas is 60% is represented by point $a_3$. The signal corresponding to the appropriate or desired pressure is out to for the comparison controller 21. Simultaneously, a signal indicating an increase of the opening is output to the damper 17. The pressure of gas of 2 kg/cm$^2$·G detected by the pressure detector 19 is compared with the signal of the appropriate pressure by means of the comparison controller 21. The opening of the damper 16 is decreased on the basis of a comparison signal output from comparison controller 21. The pressure of gas at the inlet port of the prereduction furnace 2 and the flow rate of gas is caused to enter the range between the solid line A and the solid line B in FIG. 3 by controlling the openings of the dampers 16 and 17 as described above, and the ore is appropriately fluidized. Since such control is continuously carried out on the basis of the fluctuation of the flow of gas, an appropriate fluidizing state of the ore can be constantly maintained.

Subsequently, an example wherein an operation is carried out under the condition of the pressure of gas of 0.8 kg/cm$^2$·G at the inlet port of the prereduction furnace 2, and the flow rate of gas was increased from 100% to 160% will now be described with specific reference to FIG. 3. In FIG. 3, the case where the pressure of gas at the inlet port is 0.8 kg/cm$^2$·G, and the flow rate is 100% is represented by point b, and the case wherein the pressure of gas at the inlet port is 0.8 kg/cm$^2$·G and the flow rate of gas is 160% is repesented by point $b_2$. The opening of the damper 16 is increased and the opening of the damper 17 is decreased. The openings of the dampers are adjusted to the pressure of gas of 2.0 kg/cm$^2$·G at the inlet port which is represented by point $b_3$ and the flow rate of gas of 160%. Since the $b_3$ point is included into the range between the solid line A and the solid line B as shown with oblique lines, the ore is appropriately fluidizied in the prereduction furnace 2. Prereduced ore of more than 0.5 mm in particle size is prevented from being scattered.

In the case where only the pressure of gas at the inlet port of the prereduction furnace 2 is changed at a definite flow rate of gas by the fluctuation of gas generated in the smelting reduction furnace, when the pressure of gas at the inlet port of the prereduction furnace is controlled as described above, the state of gas inside the prereduction furnace can be controlled within the range where an appropriate fluidization of the ore can be obtained.

As described above, according to the method of the present invention, even when the pressure and flow rate of gas generated in the smelting reduction furnace are greatly fluctuated, the ore inside the prereduction furnace 2 can be appropriately fluidized.

In this Preferred Embodiment, the amount of generated gas can be assumed on the basis of various materials charged into the smelting reduction furnace 1 and the amount of gas blown into the furnace instead of using the flow rate detector 18. The amount of gas generated in the smelting reduction furnace can be assumed by calculating the amount of materials charged into the furnace and the amount of gas blown into the furnace.

Figure 4:
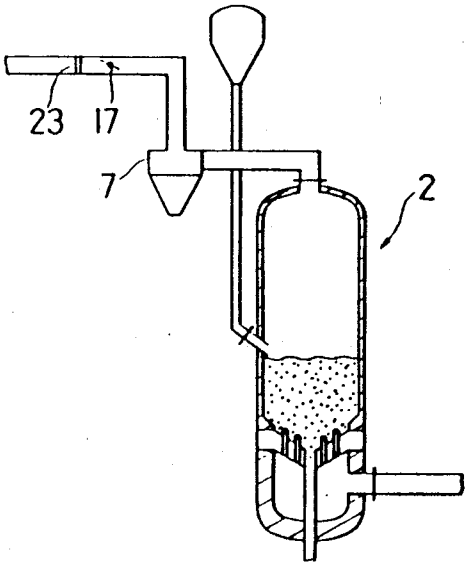
FIG. 4 is a vertical sectional view illustrating a fluidized bed type furnace of the present invention.

A cooler for cooling the exhaust gas and a dust catcher for removing dust from the exhaust gas can be mounted on the upstream side of the flow rate detector 18 in the duct 11. Accuracy and service life of the flow rate detector 18 are thus increased. As shown in FIG. 4, an orifice 23 having a predetermined opening can be arranged in the conduit on the downstream side of the damper 17 to reduce the effective diameter for the conduit, thereby serving as a flow restriction. The pressure and flow rate of gas can be controlled with the opening degree of the damper 17 (with the orifice 23 present) larger than would be the opening degree of the damper 17 without the provision of the orifice 23. Accuracy in operation and measurement is increased by the combination of the damper 17 and orifice 23 since the operation may be carried out with about a 50% opening degree of the damper 17. Moveover, since the opening of the damper 17 becomes comparatively large, it is difficult for dust in the exhuast gas to adhere to the damper 17. Although dust may adhere to the damper 17, the opening of the damper 17 still be properly controlled. The orifice 23 can be arranged on the downstream side of the damper 17 or orifices 23 can be arranged both on the upstream side and on the downstream side of damper 17.

When some of the gas generated from the smelting reduction furnace is extracted from the ducts 8 and 9 between the smelting reduction furnace 2 and the damper 16 and exhausted out of the system through the control valve, the amount of generated gas to be sent to the prereduction furnace can be optionally decreased, by which maneuverability of the operation is further increased.

As the value for controlling the opening which is arranged in the flow passage 3 for reducing gas and the flow passage 4 for exhaust gas, not only can the damper of the butterfly valve type as used in the illustrated example of the present invention be used, but also various sorts of valves for controlling the opening such as a gate type valve can be used. The valves for controlling the opening can be constituted by a plurality of valves.

In the aforementioned control of the flow rate of gas, the operation of the prereduction furnace 2 can be maintained to be optimum by means of what is called a constant value control wherein the pressure of gas at the inlet port of the prereduction furnace 2 is constantly kept at a predetermined value independent of the pressure of gas generated in the smelting reduction furnace 1. On this occasion, when the pressure of gas at the inlet port of the prereduction furnace 2 is kept as high as possible, the density of gas can be increased, which can enhance the efficiency of prereduction.

It is a matter of course that the method and apparatus of the present invention can be applied not only to the smelting and reducing of iron ore for steel making, but also to the smelting and reducing of ores of other metals.

According to the method and apparatus of the present invention, even though the pressure and flow rate of gas generated in the smelting reduction furnace fluctuate greatly depending on the operation of the smelting reduction furnace, the ore can be maintained to be in the appropriately fluidized state in the fluidized bed type prereduction furnace and can be appropriately prereduced. Since the ore can be appropriately prereduced in this way independent of the amount and pressure of gas generated in the smelting reduction furnace, a flexible control of production and change of operational conditions as the essential features of the smelting reduction of iron ore can be optionally carried out. Moreover, since the above-described effect can be produced by only arranging the valves for controlling the opening in the flow passage of gas and controlling the opening thereof, a burden of high equipment and operation costs is avoided.

What is claimed is:

1. A method for controlling a flow rate of a gas for prereducing ore, in a system comprising a smelting reduction furnace coupled to a prereduction furnace having ore in the form of a fluidized ore bed, the method comprising the steps of:

feeding substantially all of gas generated in said smelting reduction furnace to said prereduction furnace through a first gas flow passage, said first gas flow passage coupling said smelting reduction furnace to said prereduction furnace;

prereducing ore in said prereduction furnace having said fluidized bed with said gas fed to said prereduction furnace through said first gas flow passage;

exhausting said gas used for prereducing ore from said prereduction furnace through a second gas flow passage;

smelting and reducing the prereduced ore in said smelting reduction furnace;

controlling an actual flow rate of said gas generated in said smelting reduction furnace and fed into said prereduction furnace through said first gas flow passage by controlling a pressure of said gas fed to said prereduction furnace through said first gas flow passage with a gas pressure control valve positioned in said first gas flow passage, the pressure controlled gas being fed to said prereduction furnace and the pressure of said pressure controlled gas being controlled on the basis of a pressure valve detected by a pressure detector positioned at a gas inlet port positioned inside said prereduction furnace; and the actual flow rate of said gas being fed into said prereduction furnace being controlled so that the actual flow rate is larger than a minimum reference value of the actual flow rate required to cause the ore in the fluidized bed to be fluidized, and is smaller than a maximum reference value of the actual flow rate of said gas.

2. The method of claim 1, wherein the controlling step comprises lowering the pressure of said gas fed to said prereduction furnace through said first gas flow passage by decreasing an opening of said gas pressure control valve when the actual flow rate of said gas is smaller than the minimum reference value of the actual flow rate of said gas.

3. The method of claim 1, wherein the controlling step comprises elevating the pressure of said gas fed to said prereduction furnace through said first gas flow passage by increasing said opening of said gas pressure control valve when the actual flow rate of said gas is larger than the maximum reference value of the actual flow rate of said gas.

4. The method of claim 1, wherein said actual flow rate of said gas fed to said prereduction furnace through said first gas flow passage is detected by a gas flow detector positioned in said second gas flow passage.

5. The method of claim 1, wherein said actual flow rate of said gas fed into said prereduction furnace through said first gas flow passage is calculated on the basis of an amount of a material charged into said smelting reduction furnace and an amount of gas exhausted from the prereduction furnace and fed into said smelting reduction furnace through said second gas flow passage.

6. The method of claim 1, further comprising controlling the flow rate of said gas exhausted from the prereduction furnace with a flow rate control device positioned in the second gas flow passage.

7. A method for controlling a flow rate of gas for prereducing ore, comprising the steps of:

feeding substantially all of a gas generated in a smelting reduction furnace to a prereduction furnace through a first gas flow passage, said first gas flow passage coupling said smelting reduction furnace to said prereduction furnace;

prereducing ore in said prereduction furnace having a fluidized bed of ore, with the gas fed to said prereduction furnace through the first gas flow passage;

exhausting said gas used for prereducing ore from said prereduction furnace through a second gas flow passage;

smelting and reducing prereduced ore in said smelting reduction furnace;

controlling an actual flow rate and a pressure of said gas generated in said smelting reduction furnace and fed to said prereduction furnace through said first gas flow passage with a gas pressure control valve positioned in said first gas flow passage, the pressure of said gas fed to said prereduction furnace being controlled on the basis of a pressure value detected by a pressure detector positioned at a gas inlet port positioned in said prereduction furnace; and controlling said flow rate of said gas exhausted from the prereduction furnace with a gas flow rate control device positioned in the second gas flow passage, said pressure of said gas fed into the preduction furnace through the first gas flow passage and said flow rate of said gas exhausted from the prereduction furnace being controlled with said gas pressure control valve positioned in said first gas flow passage, and said gas flow rate control device being positioned in said second gas flow passage so as to maintain the pressure in the prereduction furnace between a preselected minimum value and a maximum value by controlling the gas flow rates of said gas into and out of said prereduction furnace.

8. An apparatus for controlling a flow rate of gas for prereducing ore, in a system comprising a smelting reduction furnace coupled to a prereduction furnace having an ore in the form of a fluidized ore bed, the apparatus comprising:

a first gas flow passage for feeding substantially all of a gas generated in said smelting reduction furnace to said prereduction furnace having the fluidized bed;

a second gas flow passage for exhausting the gas used for prereducing ore;

a gas pressure control valve positioned in said first gas flow passage for controlling an actual flow rate and pressure of said gas fed to said prereduction furnace by controlling the pressure of said gas generated in said smelting reduction furnace and fed into said prereduction furnace;

a gas flow rate control device positioned in said second gas flow passage for controlling said flow rate of said gas exhausted from said prereduction furnace;

a gas pressure detector for detecting a pressure of said gas at an inlet port positioned in said prereduction furnace, said gas pressure at said inlet port being controlled with said gas pressure control valve positioned in said first gas flow passage;

a gas flow rate detector positioned in said second gas flow passage for measuring the flow rate of said gas exhausted from said prereduction furnace, said thus measured flow rate of said gas being exhausted from said prereduction furnace being controlled with said gas flow rate control device positioned in said second gas flow passage;

an arithmetic control unit for processing said detected pressure at said inlet port of said prereduction furnace and a measured flow rate of said gas exhausted from said prereduction furnace, and for transmitting a control command to said gas pressure control valve and to said gas flow rate control device to thereby control the gas flow into and out of said prereduction furnace.

9. The apparatus of claim 8, wherein said gas flow rate control device comprises a flow rate control valve.

10. The apparatus of claim 9, wherein said gas flow rate control device comprises an orifice.

* * * * *

UNITED STATES PATENT AND TRADEMARK OFFICE

CERTIFICATE OF CORRECTION

PATENT NO. : 5,183,495

DATED : February 2, 1993

INVENTOR(S) : Tatsuo ARIYAMA et al

It is certified that error appears in the above-indentified patent and that said Letters Patent is hereby corrected as shown below:

In the title page, under Section [56] References Cited "FOREIGN PATENT DOCUMENTS", line 1, before "227009" insert --62--

Column 5, line 4, after "medium" insert --particle--

Column 5, line 4, after "coarse" insert --particle--

Column 7, line 66, after "point" change "a" to --$a_1$--

Column 8, line 28, after "point" change "b" to --$b_1$--

Column 9, line 12, delete "becomes" insert --may be kept--

Column 9, line 12, after "large" insert --due to the provision of the flow restricting orifice 23--

Column 8, line 12, after "opening" insert - - degree- -.

Signed and Sealed this

Sixth Day of February, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,183,495

DATED : February 2, 1993

INVENTOR(S) : Tatsuo Ariyama et al

It is certified that error appears in the above-identified patent and that said Letters Patent is hereby corrected as shown below: --

On the title page, under Section [56] References Cited "FOREIGN PATENT PATENT DOCUMENTS", line 1, before "227009" insert --62- --.

Column 5, line 4, after "medium" insert --particle--.
Column 5, line 4, after "coarse" insert --particle--.
Column 7, line 66, after "point" change "a" to --$a_1$--.
Column 8, line 28, after "point" change "b" to --$b_1$--.
Column 9, line 11, after "opening" insert --degree--.
Column 9, line 12, delete "becomes" insert --may be kept--.
Column 9, line 12, after "large" insert --due to the provision of the flow restricting orifice 23--.

This certificate supersedes Certificate of Correction issued February 6, 1996.

Signed and Sealed this

Eleventh Day of June, 1996

*Attest:*

*Attesting Officer*

Bruce Lehman

BRUCE LEHMAN

*Commissioner of Patents and Trademarks*